US008669927B2

(12) United States Patent
Lee

(10) Patent No.: US 8,669,927 B2
(45) Date of Patent: Mar. 11, 2014

(54) LIQUID CRYSTAL DISPLAY DEVICE AND DRIVING METHOD THEREOF

(75) Inventor: Jeong Geun Lee, Daegu (KR)

(73) Assignee: LG Display Co., Ltd., Seoul (KR)

( * ) Notice: Subject to any disclaimer, the term of this patent is extended or adjusted under 35 U.S.C. 154(b) by 363 days.

(21) Appl. No.: 12/549,722

(22) Filed: Aug. 28, 2009

(65) Prior Publication Data

US 2010/0134530 A1 Jun. 3, 2010

(30) Foreign Application Priority Data

Nov. 28, 2008 (KR) ..... 10-2008-0119463

(51) Int. Cl.
*G09G 3/36* (2006.01)

(52) U.S. Cl.
USPC ..... 345/87; 345/89; 345/204

(58) Field of Classification Search
None
See application file for complete search history.

(56) References Cited

U.S. PATENT DOCUMENTS

| | | | | |
|---|---|---|---|---|
| 2002/0080100 | A1* | 6/2002 | Son et al. | 345/87 |
| 2006/0158410 | A1 | 7/2006 | Fujine | |
| 2008/0001889 | A1* | 1/2008 | Chun et al. | 345/96 |
| 2009/0140964 | A1* | 6/2009 | Chiang | 345/87 |

FOREIGN PATENT DOCUMENTS

| | | | |
|---|---|---|---|
| CN | 1379388 | A | 11/2002 |
| KR | 10-2003-0095320 | A | 12/2003 |
| KR | 10-2005-0097968 | A | 10/2005 |

OTHER PUBLICATIONS

Chinese Office Action issued Jan. 18, 2012 in a corresponding Chinese patent application.
Korean Office Action dated Apr. 1, 2013 issued in Korean Patent Application No. 2008-0119463.

* cited by examiner

*Primary Examiner* — Joseph Haley
(74) *Attorney, Agent, or Firm* — Morgan, Lewis & Bockius LLP

(57) ABSTRACT

An LCD device improving picture-quality and a driving method thereof are disclosed.
The LCD device and the driving method thereof generates analog normal driving gamma values and analog black data driving gamma values according to a driving mode selection signal which designates any one of a normal driving mode and a black data driving mode. Also, the LCD device and the driving method thereof provides RGB data voltages compensated with any one of the analog normal driving gamma values and the analog black data driving gamma values. In other words, the LCD device and the driving method thereof allow the normal driving gamma values to be used in the normal driving mode and the black data driving gamma values to be used in the black data driving mode. Therefore, brightness in the black data driving mode can maintains almost equally to that in the normal driving mode. As a result, the deterioration of picture-quality can be prevented.

3 Claims, 6 Drawing Sheets

LIQUID CRYSTAL DISPLAY DEVICE AND DRIVING METHOD THEREOF

CROSS-REFERENCE TO RELATED APPLICATION

This application claims priority under 35 U.S.C. 119 to Korean Patent Application No. 10-2008-0119463, filed on Nov. 28, 2008, which is hereby incorporated by reference in its entirety.

BACKGROUND

1. Field of the Disclosure

This disclosure relates to a liquid crystal display device with improved picture quality, and a driving method thereof.

2. Description of the Related Art

As the information society grows, flat display devices capable of displaying information have been widely developed. These flat display devices include liquid crystal display (LCD) devices, organic electro-luminescence display (OLED) devices, plasma display devices, and field emission display devices. Among the above display devices, LCD devices have the advantages that they are light and small and provide a low power drive and a full color scheme. Accordingly, LCD devices have been widely used for mobile phones, navigation systems, portable computers, televisions and so on.

The LCD device controls the transmittance of a liquid crystal on a liquid crystal panel, thereby displaying a desired image. The LCD device generally displays an image in a hold type unlike the impulse type of the cathode ray tube (CRT) display device according to the related art. This results from the fact that its liquid crystal has a slow response time.

FIGS. 1A and 1B are graphic diagrams showing light density variations for time in the LCD device and the CRT display devices according to the related art. As shown in FIG. 1A, the related art CRT display device displays the image in the impulse type that the light density is discontinuously varied. Meanwhile, the related art LCD device displays in the hold type that the light density is continuously varied as shown in FIG. 1B. When a motion image changing every frame is displayed on the LCD device of the hold type, an object dragging phenomenon, i.e., a motion blur, is generated.

To address this matter, an LCD device of the impulse type has been proposed which forces the image not to be periodically displayed.

FIG. 2 is a graphic diagram showing data voltage variation for time in an LCD device of the impulse type. As shown in FIG. 2, the LCD device of the impulse type according to the related art divides one frame period into a display interval, actually displaying a desired image, and a non-display interval, not displaying any image. Also, the LCD device provides a desired data voltage in the display interval, but a black data voltage not displaying any image in the non-display interval. In this matter, since the black data voltage is applied in the non-display interval and no image is display during the non-display interval, the motion blur phenomenon can be prevented.

FIG. 3 is a block diagram showing an LCD device of the impulse type according to the related art. The LCD device of the impulse type according to the related art can selectively perform a normal driving mode without the black data and a black data driving mode with the black data.

Referring to FIG. 3, a timing controller 1 generates gate control signals for controlling a gate driver 3 and data control signals for driving a data driver 8. The data control signals include a driving mode control signal enabling either the normal driving mode or the black data driving mode to be performed.

The gate driver 3 applies a gate signal to a liquid crystal panel 9 in response to the gate control signals.

The data driver 8 converts red, green, and blue data (hereinafter, "RGB data") into analog data voltages which are compensated with (or which reflect) a gamma value generated in a gamma generator 7. Also, the data driver 8 applies only the analog data voltages or alternately these together with a black data voltage to the liquid crystal panel 9, according to the driving mode control signal applied from the timing controller 1. More specifically, if the normal driving mode is designated by the driving mode control signal, only the analog data voltages are applied to the liquid crystal panel 9 during one frame period. On the contrary, when the driving mode control signal designates the black data driving mode, the analog data voltages are applied to the liquid crystal panel 9 in the display interval of one frame period and a black data voltage is applied to the liquid crystal panel 9 in the non-display interval of the frame period. The analog data voltage applied to the liquid crystal panel 9 is generated in such a manner as to reflect the gamma value without regard to the normal driving mode and the black data driving mode.

However, a liquid crystal included in the liquid crystal panel 9 has no time enough to respond to the analog data voltage applied in the display interval due to the affect of the black data voltage applied in the non-display interval in the black data driving mode. As such, brightness is deteriorated. Referring to experimental brightness variations along gray levels in the normal and black data driving modes, as shown in FIG. 5, it is evident that the level of brightness in the black data driving mode is entirely reduced in comparison with that in the normal driving mode.

On the other hand, the gamma generator 7 of the LCD device of the impulse type according to the related art includes a plurality of resistors R1 to Rn connected serially, as shown in FIG. 4. The gamma generator 7 provides divided voltages on nodes between the resistors R1~Rn as gamma voltages GAMMA1 to GAMMAn-1.

BRIEF SUMMARY

Accordingly, the present embodiments are directed to an LCD device that substantially obviates one or more of problems due to the limitations and disadvantages of the related art.

An object of the embodiment of the present disclosure is to provide an LCD device that has uniform brightness without regard to normal and black data driving modes to improve picture-quality, and a driving method thereof.

Additional features and advantages of the embodiments will be set forth in the description which follows, and in part will be apparent from the description, or may be learned by practice of the embodiments. The advantages of the embodiments will be realized and attained by the structure particularly pointed out in the written description and claims hereof as well as the appended drawings.

According to one general aspect of the present embodiment, an LCD device includes a liquid crystal panel including a plurality of pixels arranged in a matrix, a gamma generator selectively generating analog normal driving gamma values and analog black data driving gamma values according to a driving mode selection signal including any one of normal and black data driving modes, a gate driver driving the liquid crystal panel, and a data driver supplying the liquid crystal panel with RGB data voltages reflecting any one of the analog normal driving gamma values and the analog black data driving gamma values.

An LCD device driving method according to another aspect of the present embodiment includes selectively generating analog normal driving gamma values and analog black data driving gamma values according to a driving mode selection signal including any one of normal and black data driving modes, and providing RGB data voltages reflecting any one of the analog normal driving gamma values and the analog black data driving gamma values.

Other systems, methods, features and advantages will be, or will become, apparent to one with skill in the art upon examination of the following figures and detailed description. It is intended that all such additional systems, methods, features and advantages be included within this description, be within the scope of the invention, and be protected by the following claims. Nothing in this section should be taken as a limitation on those claims. Further aspects and advantages are discussed below in conjunction with the embodiments. It is to be understood that both the foregoing general description and the following detailed description of the present disclosure are exemplary and explanatory and are intended to provide further explanation of the disclosure as claimed.

BRIEF DESCRIPTION OF THE DRAWINGS

The accompanying drawings, which are included to provide a further understanding of the embodiments and are incorporated in and constitute a part of this application, illustrate embodiment(s) of the invention and together with the description serve to explain the disclosure. In the drawings.

DETAILED DESCRIPTION

Figure 1A:
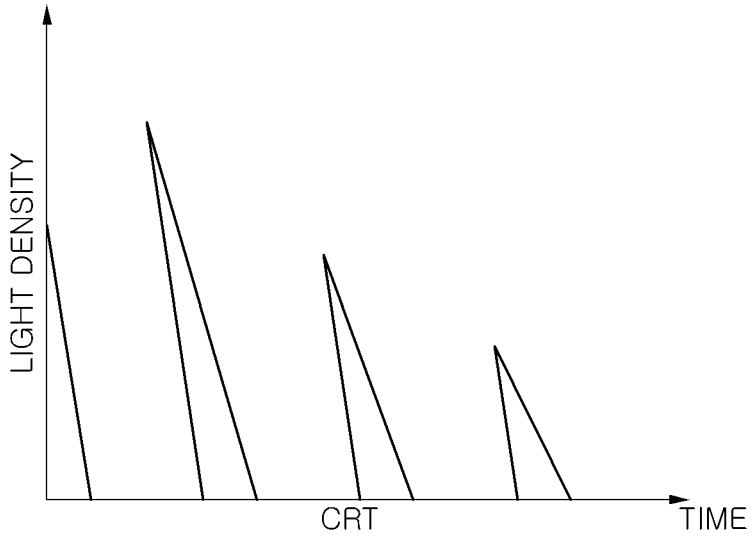
FIG. 1A (Related Art)
FIGS. 1A and 1B are graphic diagrams showing light density variations for time in the CRT display device and the LCD device of the related art.
Figure 1B:
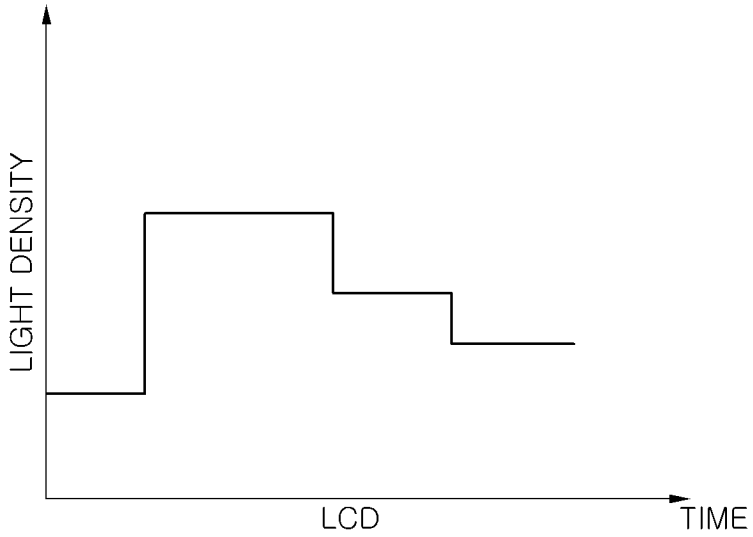
FIG. 1B (Related Art)
Figure 2:
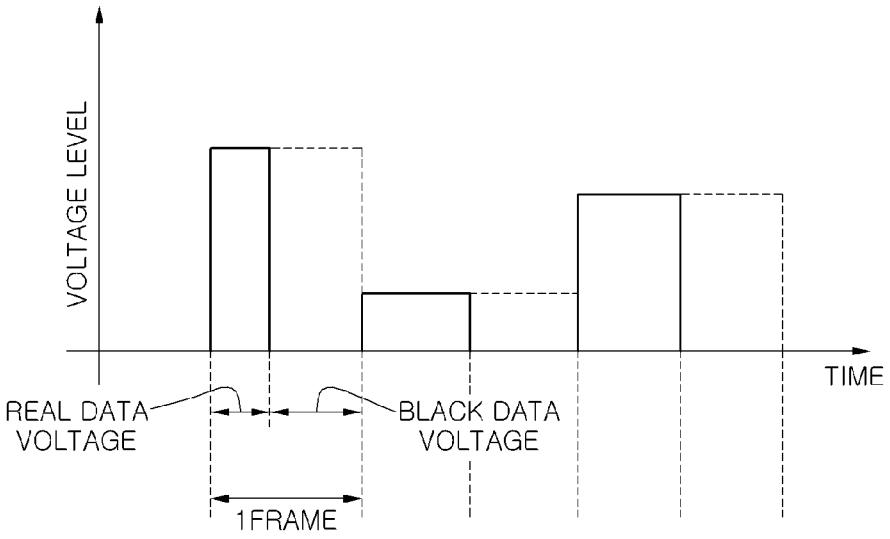
FIG. 2 (Related Art)
FIG. 2 is a graphic diagram showing a data voltage variation for time in the LCD device of an impulse type.
Figure 3:
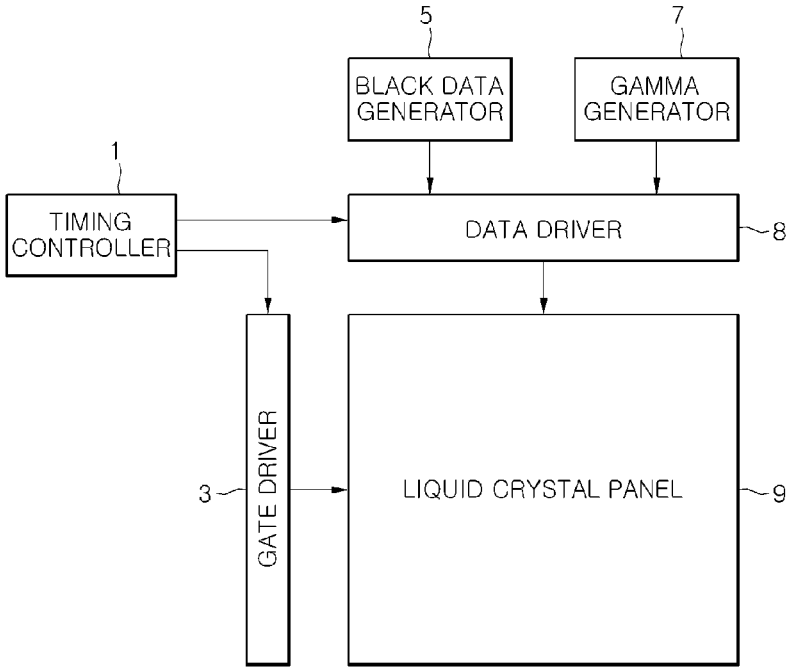
FIG. 3 (Related Art)
FIG. 3 is a block diagram showing the LCD device of an impulse type according to the related art.
Figure 4:
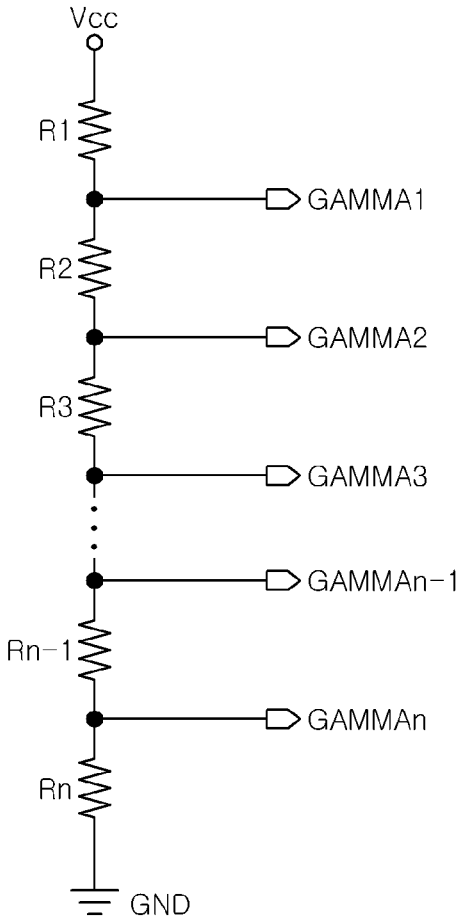
FIG. 4 (Related Art)
FIG. 4 is a circuitry diagram showing in detail the gamma generator of FIG. 3.
Figure 5:
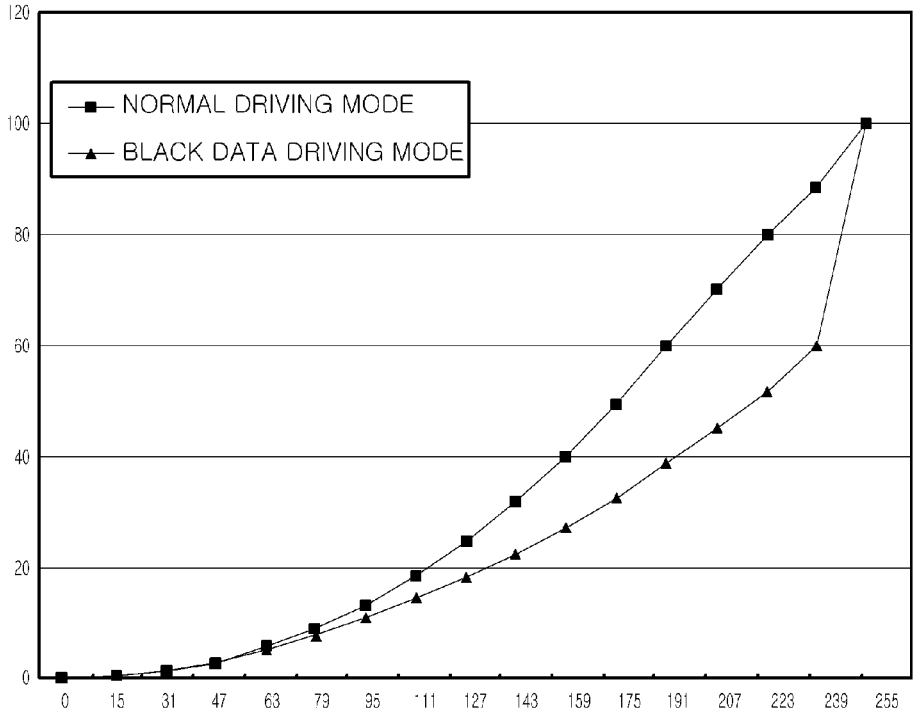
FIG. 5 (Related Art)
FIG. 5 is a graphic diagram showing brightness variations when normal and black data driving modes are performed by an LCD device according to the related art.

Reference will now be made in detail to the embodiments of the present disclosure, examples of which are illustrated in the accompanying drawings. These embodiments introduced hereinafter are provided as examples in order to convey their spirits to the ordinary skilled person in the art. Therefore, these embodiments might be embodied in a different shape, so are not limited to these embodiments described here. Also, the size and thickness of the device might be expressed to be exaggerated for the sake of convenience in the drawings. Wherever possible, the same reference numbers will be used throughout this disclosure including the drawings to refer to the same or like parts.

Figure 6:
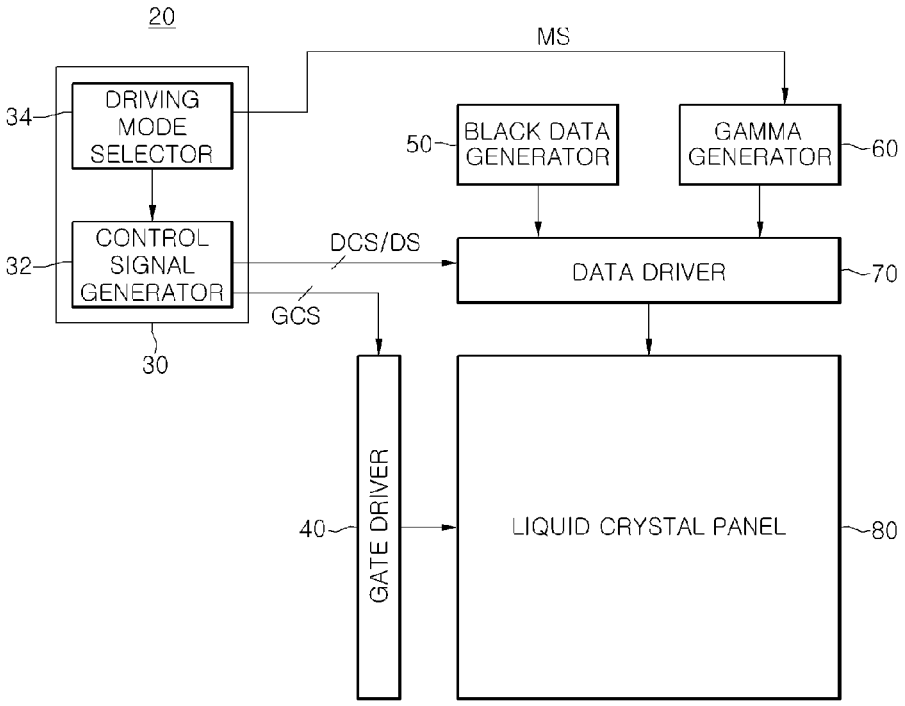
FIG. 6 is a block diagram showing the LCD device of an impulse type according to an embodiment of the present disclosure.
Figure 7:
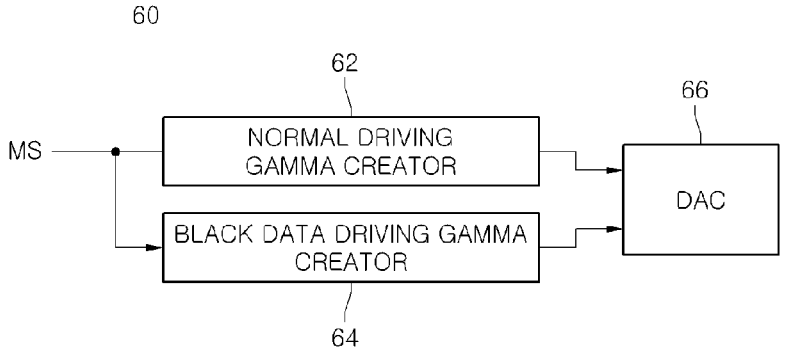
FIG. 7 is a block diagram showing in detail the gamma generator of FIG. 6.
Figure 8:
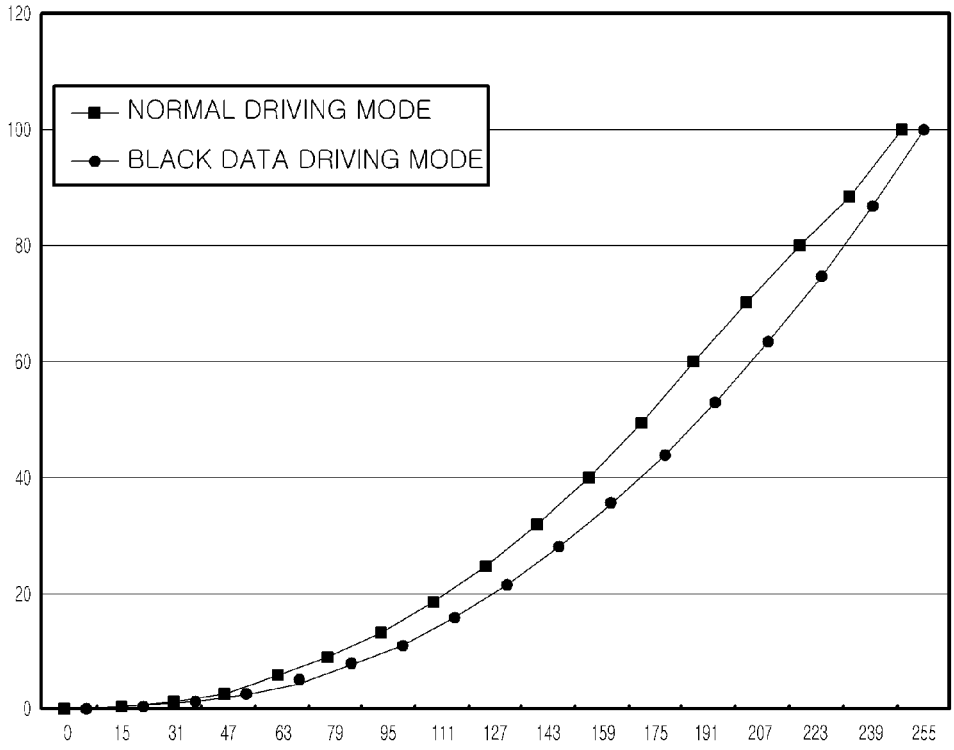
FIG. 8 is a graphic diagram showing brightness variations when normal and black data driving modes are performed by an LCD device according to an embodiment of the present disclosure.

FIG. 6 is a block diagram showing the LCD device of an impulse type according to an embodiment of the present disclosure. FIG. 7 is a block diagram showing in detail the gamma generator of FIG. 6. FIG. 8 is a graphic diagram showing brightness variations when normal and black data driving modes are performed by an LCD device according to an embodiment of the present disclosure. Referring to FIG. 6, the LCD device of an impulse type according to an embodiment of the present disclosure includes a timing controller 30, a gate driver 40, a black data generator 50, a gamma generator 60, a data driver 70, and a liquid crystal panel 80. The liquid crystal panel 80 includes a lower substrate (not shown), an upper substrate (not shown), and a liquid crystal layer (not shown) interposed therebetween.

The lower substrate includes a plurality of gate lines (not shown), a plurality of data lines (not shown), thin film transistors (not shown) connected to the respective gate and data lines, and pixel electrodes (not shown) connected to the respective thin film transistors. The gate lines and the data lines define sub-pixels. The sub-pixels include red, green, and blue sub-pixels. The red, green, and blue sub-pixels configure a unit pixel (or a color pixel). These unit pixels are arranged in a matrix on the lower substrate so that a display area is defined.

Color filters (not shown) can be arranged corresponding to the sub-pixels on the upper substrate opposite to the lower substrate, and a black matrix (not shown) shielding light can be disposed between the color filters. The color filters may include red, green, and blue color filters (not shown). Each red color filter may face the red sub-pixel, each green color filter may face the green sub-pixel, and each blue color filter may face the blue sub-pixel. The black matrix may also be disposed opposite the gate lines, the data lines, and the thin film transistors.

The upper substrate can further include a common electrode (not shown) disposed on the color filters and the black matrix. In this case, the liquid crystal layer is driven by a vertical electric field. To this end, the liquid crystal layer may include liquid crystal of a twisted nematic mode. On the other hand, the common electrode can be disposed alternately with the pixel electrode on the lower substrate. As such, the liquid crystal layer may be driven by an in-plane electric field (or a horizontal electric field). Such a liquid crystal layer may include liquid crystal of an in-plane switching mode. Consequently, the LCD device of the present embodiment can use liquid crystals, all of which are twisted nematic mode or in-plane switching mode.

Such a liquid crystal panel 80 generates the electric field by means of a data voltage and a common voltage applied to the pixel electrode and the common electrode, respectively so that the molecules of the liquid crystal layer are displaced (realigned) by the electric field, thereby adjusting the amount of transmitting light. Accordingly, an imaged may be displayed on the liquid crystal panel 80.

The timing controller 30 externally inputs synchronous signals, such as a dot clock, a horizontal synchronous signal, a vertical synchronous signal, and a data enable signal, together with RGB data. The timing controller 30 also includes a control signal generator 32 and a driving mode selector 34. The timing controller 30 further can include a data re-arranger (not shown).

The data re-arranger re-arranges the RGB data applied serially or parallel from the exterior into a display shape required by the liquid crystal panel 80. The re-arranged RGB data can be applied to the data driver 70.

The control signal generator 32 uses the synchronous signals and generates gate control signals GCS for controlling the gate driver 40 and data control signals DCS for controlling the data driver 80. The gate control signals GCS are applied to the gate driver 40, and the data control signals DCS are applied to the data driver 70. The gate control signals GCS may include a gate shift pulse, a gate clock signal, and a gate output enable signal. The data control signals DCS may also include a source shift pulse, a source clock signal, a source output enable signal, and a polarity signal POL.

The driving mode selector 34 receives a selection signal for driving-modes from a user, analyzes the received selection signal, and determines whether the user has selected any one of the normal and black data driving modes. The driving mode selector 34 generates a driving mode selection signal MS corresponding to the selected driving-mode and applies it to the control signal generator 32 and the gamma generator 60. In accordance therewith, the control signal generator 32 derives a driving mode control signal DS, indicating the operation in any one of the normal and black data driving modes, from the mode selection signal MS and applies it to the data driver 70.

The gate driver 40 responds to the gate control signals and generates gate signals to be sequentially applied to the gate lines on the liquid crystal panel 80.

The black data generator 50 generates a black data voltage to be provided to in the non-display interval of one frame period when the black data driving mode is performed. The black data voltage is determined according to whether the liquid crystal panel is either a normally black mode or a normally white mode.

More specifically, if the liquid crystal panel 80 has the normally black mode, the liquid crystal panel 80 displays a black picture when the data voltage is not applied at all. Therefore, the black data voltage may become the same voltage level as the common voltage applied to the common electrode on the liquid crystal panel 80. On the contrary, if the liquid crystal panel 80 has the normally white mode, it displays the black picture when the data voltage of a maximum level is applied to the liquid crystal panel 80. In this case, the black data voltage may have the same voltage level as the maximum data voltage which can be applied to the liquid crystal panel 80. The maximum data voltage means the analog data voltage of a maximum level which reflects a gamma value from the gamma generator 60 for the display of an analog black data, as described below.

The gamma generator 60 can include a normal driving gamma creator 62, a black data driving gamma creator 64, and a digital-to-analog converter (DAC) 66. The normal driving gamma creator 62 establishes a plurality of gamma values for the compensation of the analog data voltage in case only the analog data voltages are provided during one frame period. The black data driving gamma creator 64 establishes a plurality of gamma values for the compensation of the analog data voltage in case the analog data voltages are provided in a display interval of one frame period and the black data voltage is provided in a non-display interval of one frame period.

The gamma values (normal driving gamma values) established in the normal driving gamma creator 62 and the gamma values (black data driving gamma values) established in the black data driving gamma creator 64 can be provided in a table, respectively. Also, the normal driving gamma values and the black data driving values may all be digital gamma values. Furthermore, the normal driving gamma values and the black data driving gamma values may have different values from one another according to whether the liquid crystal panel 80 is either in the normally black mode or in the normally white mode.

Actually, the liquid crystal panel 80 of the normally white mode approaches white as the data voltage comes close to the common voltage applied to the common electrode. In this case, the black data driving gamma values may have values lower than the normal driving gamma values, at least. As such, brightness becomes higher in the black data driving mode and can be maintained equally to that of the normal driving mode, even though the data voltage is applied in the non-display interval of one frame period.

On the contrary, the liquid crystal panel 80 of the normally black mode approaches white brightness as the data voltage goes away from the common voltage applied to the common electrode. In this case, the black data driving gamma values may have values higher than the normal driving gamma values, at least. As such, brightness becomes higher in the black data driving mode and can be maintained equally to that of the normal driving mode, even though the data voltage is applied in the non-display interval of one frame period.

The DAC 66 selectively converts the digital normal driving gamma values established in the normal driving gamma creator 62 and the digital data driving gamma values established in the black data driving gamma creator 64 into analog gamma values (or analog gamma voltages).

In this manner, the LCD device converts the digital gamma values into the analog gamma values (or the analog gamma voltages) and uses them as such, while the device of the related art generates gamma values using resistors. Therefore, the LCD device of the present embodiment cuts element costs regarding the gamma generator consisting of the resistors. Also, the LCD device of the related art employing the resistors generates distorted gamma values due to external signals, noise, and so on. Meanwhile, the LCD device of the present embodiment is not subject to any external signal and does not distort the gamma values, because it has the established digital gamma values.

Consequently, the LCD device of the present embodiment compensates the decrement of brightness caused by the related art LCD device using the same gamma values as the normal driving mode in the black data driving mode, thereby preventing the deterioration of picture-quality. This results from the fact that the black data driving gamma values increase the brightness more than with the normal driving gamma values.

The data driver 70 converts the RGB data into analog RGB data voltages that reflect the normal driving gamma values or the black data driving gamma values from the gamma generator 60 according to the data control signals DCS and the driving control signal DS supplied from the timing controller 30. The data driver 70 applies the analog RGB data voltages to the liquid crystal panel 80.

If the driving control signal DS indicates the normal driving mode, the data driver 70 converts the RGB data into the analog RGB data voltage reflecting the normal driving gamma values applied from the gamma generator 60. The analog RGB data voltages are applied to the liquid crystal panel 80 during one frame period.

In the other manner, if the driving control signal DS designates the black data driving mode, the data driver 70 converts the RGB data into the analog RGB data voltage reflecting the black data driving gamma values from the gamma generator 60. The analog RGB data voltages are applied to the liquid crystal panel 80 in the display interval of one frame period. Also, the data driver 70 transfers the black data voltage from the black data generator 50 to the liquid crystal panel 80 in the non-display interval of one frame period.

The non-display interval may continue to run after the data voltage is applied to every pixel on each gate line of the liquid crystal panel 80 until the next frame, or may become a period for which the black data voltage is applied to the pixels on any one gate line. The former means that the black data voltage is applied in bulk to the pixels on every gate line on the liquid crystal panel 80, and the latter means that the black data voltage is applied individually (or in a line) to the pixels of the gate lines on the liquid crystal panel 80.

The operation of the LCD device having the above configuration will now be explained.

Firstly, when a user selects one of the driving modes, the driving mode selector 34 generates the driving mode selection signal MS corresponding to the mode selected by the user, and applies the driving mode selection signal MS to the control signal generator 32 and the gamma generator 60.

The control signal generator 32 supplies the data driver 70 with a driving mode control signal DS corresponding to the driving mode selection signal MS.

The gamma generator 60 selectively converts the digital normal driving gamma values and the digital black data driving gamma values into the analog gamma values (i.e., analog gamma voltages) according to the driving mode selection signal MS generated in the driving mode generator 34. Also, the gamma generator 60 supplies the data driver 70 with the converted analog gamma values. More specifically, if the driving mode selection signal MS indicates the normal driving mode, the gamma generator 60 converts the digital normal driving gamma values into the analog normal driving gamma values and applies these analog normal driving gamma values to the data driver 70. On the contrary, when the driving mode selection signal MS indicates the black data driving mode, the gamma generator 60 converts the digital black data driving gamma values into the analog black data driving gamma values, and applies these analog black data driving values to the data driver 70.

The data driver 70 supplies the liquid crystal panel 80 either with only the analog RGB data voltages for the normal driving mode, or else the analog RGB data voltages for the black data driving mode and the analog black data voltage alternately with each other. In detail, if the driving mode control signal DS designates the normal driving mode, the data driver 70 converts the digital RGB data into the analog RGB data voltages compensated with the analog normal driving gamma values and applies those to the liquid crystal panel 80. When the driving mode control signal DS designates the black data driving mode, the data driver 70 converts the digital RGB data into analog RGB data voltages compensated with the black data driving gamma values generated in the gamma generator 60. In this case, the analog RGB data voltages are applied to the liquid crystal panel 80 in such a manner as to alternate with the analog black data voltage in each frame.

In accordance therewith, the liquid crystal panel 80 displays an image corresponding to the analog RGB data voltages compensated with the analog normal driving gamma values or to the analog RGB data voltages compensated with the analog black data driving gamma voltages.

In this way, the level of brightness in the black data driving mode almost comes close to that in the normal driving mode, as shown in FIG. 8, because the analog RGB data voltages compensated with the black data driving gamma values are generated in the black data driving mode.

As described above, the LCD device according to an embodiment of the present disclosure includes different gamma value sets to be applied to the normal driving mode and the black data driving mode respectively. Also, the LCD device uses the normal driving gamma value set in the normal driving mode and the black data driving gamma value set in the black data driving mode. Therefore, the black data driving mode can maintain a level of brightness almost equal to that of the normal driving mode, thereby preventing a deterioration of picture-quality.

Although the present disclosure has been limitedly explained regarding only the embodiments described above, it should be understood by the ordinary skilled person in the art that the present disclosure is not limited to these embodiments, but rather that various changes or modifications thereof are possible without departing from the spirit of the present disclosure. Accordingly, the scope of the present disclosure shall be determined only by the appended claims and their equivalents.

What is claimed is:

1. A liquid crystal display device comprising:

a liquid crystal panel including a plurality of pixels arranged in a matrix;

a driving mode selector generating a driving mode selection signal, the driving mode selection signal including any one of a normal driving mode and a black data driving mode selected by a user;

a control signal generator generating a driving control signal corresponding to the driving mode selection signal from the driving mode selector and a gate control signal and a data control signal for controlling the liquid crystal panel;

a normal driving gamma creator establishing normal driving digital gamma values;

a black data driving gamma creator establishing black data driving digital gamma values;

a digital-to-analog converter selecting one of the normal driving digital gamma values and the black data driving digital gamma values according to the driving mode selection signal from the driving mode selector, and converting the selected digital gamma values into one of normal driving analog gamma values and black data driving analog gamma values;

a gate driver supplying the liquid crystal panel with a gate signal in response to the gate control signal from the control signal generator;

a data driver converting digital RGB data into one of normal driving analog RGB voltages and black data driving analog RGB voltages reflecting the converted analog gamma values from the digital-to-analog converter according to the driving control signal from the control signal generator, and supplying the liquid crystal panel with the converted analog RGB voltages according to the data control signal from the control signal generator; and a black data generator generating an analog black data voltage and supplying the data driver with the analog black data voltage, wherein the liquid crystal panel has a normally black mode in which the black data driving digital gamma values are higher than the normal driving digital gamma values and the analog black data voltage has the same level as a level of a common voltage applied to a common electrode of the liquid crystal panel, wherein where the driving control signal represents the black data driving mode, the black data driving analog RGB data voltages reflecting the analog black data driving gamma values are applied to the liquid crystal panel during a display interval of one frame period, and the analog black data voltage is applied to the liquid crystal panel during a non-display interval of one frame.

2. The liquid crystal display device according to claim 1, wherein where the driving control signal represents the normal driving mode, the normal driving analog RGB data voltages reflecting the analog normal driving gamma values are applied to the liquid crystal panel during one frame.

3. A liquid crystal display device comprising:

a liquid crystal panel including a plurality of pixels arranged in a matrix;

a driving mode selector generating a driving mode selection signal, the driving mode selection signal including any one of a normal driving mode and a black data driving mode selected by a user;

a control signal generator generating a driving control signal corresponding to the driving mode selection signal from the driving mode selector and a gate control signal and a data control signal for controlling the liquid crystal panel;

a normal driving gamma creator establishing normal driving digital gamma values;

a black data driving gamma creator establishing black data driving digital gamma values;

a digital-to-analog converter selecting one of the normal driving digital gamma values and the black data driving digital gamma values according to the driving mode selection signal from the driving mode selector, and converting the selected digital gamma values into one of normal driving analog gamma values and black data driving analog gamma values;

a gate driver supplying the liquid crystal panel with a gate signal in response to the gate control signal from the control signal generator;

a data driver converting digital RGB data into one of normal driving analog RGB voltages and black data driving analog RGB voltages reflecting the converted analog gamma values from the digital-to-analog converter according to the driving control signal from the control signal generator, and supplying the liquid crystal panel with the converted analog RGB voltages according to the data control signal from the control signal generator; and a black data generator generating an analog black data voltage and supplying the data driver with the analog black data voltage, wherein the liquid crystal panel has a normally white mode in which the black data driving digital gamma values are lower than the normal driving digital gamma values and the analog black data voltage has the same level of the maximum voltage level of the analog RGB data voltage, wherein where the driving control signal represents the black data driving mode, the black data driving analog RGB data voltages reflecting the analog black data driving gamma values are applied to the liquid crystal panel during a display interval of one frame period, and the analog black data voltage is applied to the liquid crystal panel during a non-display interval of one frame.

* * * * *